US007511414B2

(12) United States Patent
Park et al.

(10) Patent No.: US 7,511,414 B2
(45) Date of Patent: Mar. 31, 2009

(54) FIELD EMISSION DISPLAY AND METHOD OF MANUFACTURING THE SAME

(75) Inventors: Shang-hyeun Park, Chungcheongnam-do (KR); Hang-woo Lee, Gyeonggi-do (KR); Young-suk Cho, Seoul (KR)

(73) Assignee: Samsung SDI Co., Ltd., Suwon-Si, Gyeonggi-Do (KR)

( * ) Notice: Subject to any disclaimer, the term of this patent is extended or adjusted under 35 U.S.C. 154(b) by 312 days.

(21) Appl. No.: 10/743,791

(22) Filed: Dec. 24, 2003

(65) Prior Publication Data

US 2004/0135493 A1 Jul. 15, 2004

(30) Foreign Application Priority Data

Dec. 26, 2002 (KR) ..... 10-2002-0084089

(51) Int. Cl.
*H01J 1/304* (2006.01)
*H01J 1/62* (2006.01)
*H01J 19/40* (2006.01)

(52) U.S. Cl. ..... 313/497; 313/496

(58) Field of Classification Search ..... 313/422, 313/495–497

See application file for complete search history.

(56) References Cited

U.S. PATENT DOCUMENTS 4,613,785 A * 9/1986 Ragland, Jr. ..... 313/405
5,186,670 A * 2/1993 Doan et al. ..... 445/24
5,424,605 A * 6/1995 Lovoi
5,541,473 A * 7/1996 Duboc et al. ..... 313/422
5,710,483 A 1/1998 Peng
6,373,176 B1 4/2002 Ge et al.
6,620,216 B2 * 9/2003 Oshima et al. ..... 51/309
2002/0017875 A1 * 2/2002 Lee et al. ..... 315/169.1

FOREIGN PATENT DOCUMENTS

JP 5047354 2/1993
KR 2001-0081496 A 8/2001

OTHER PUBLICATIONS

Silicon-Wikipedia, The free encyclopedia; http://en. wikipedia.org.* Invar, from Invar-Wikipedia, the free encyclopedia, retreived from http://en.wikipedia.org/wiki/Invar; pp. 1-2; Mar. 6, 2007.

* cited by examiner

*Primary Examiner*—Karabi Guharay
(74) *Attorney, Agent, or Firm*—Buchanan Ingersoll & Rooney PC

(57) ABSTRACT

A field emission display and a method of manufacturing the same are provided. The field emission display includes an anode plate where an anode electrode and a fluorescent layer are formed, a cathode plate where an electron emission source emitting electrons toward the fluorescent material layer and a gate electrode having a gate hole through which the electrons travel are formed, a mesh grid having an electron control hole corresponding to the gate hole and adhered to the cathode plate, and an insulation layer formed on a surface of the mesh grid facing the cathode plate, and spacers provided between the anode plate and the mesh grid so that the mesh grid can be adhered to the cathode plate due to a negative pressure existing between the anode plate and the cathode plate.

6 Claims, 8 Drawing Sheets
(2 of 8 Drawing Sheet(s) Filed in Color)

FIELD EMISSION DISPLAY AND METHOD OF MANUFACTURING THE SAME

BACKGROUND OF THE INVENTION

This application claims the priority of Korean Patent Application No. 2002-84089, filed on Dec. 26, 2002, in the Korean Intellectual Property Office, the disclosure of which is incorporated herein in its entirety by reference.

1. Field of the Invention

The present invention relates to a field emission display and a method of manufacturing the same, and more particularly, to a double gate-type field emission display.

2. Description of the Related Art

In some cases, when electrons are emitted from an electron emission source of a field emission display, an arc discharge occurs in a vacuum space between a cathode plate where the electron emission source is provided and an anode plate having a fluorescent surface, which the electrons collide with. Such an arcing phenomenon supposedly takes place due to an electron discharge phenomenon occurring when a considerable amount of gas is ionized (avalanche phenomenon) because of outgassing. Sometimes, the arcing phenomenon occurs when a chamber of a field emission array (FEA) formed on the cathode plate is being tested or when an anode voltage no smaller than 1 KV is applied to the cathode plate and the anode plate, which are integrated into one body. Since edges of a gate hole are considered as belonging to a high electric field and the arcing phenomenon is more likely to occur in a high electric field, the edges of the gate hole are most vulnerable to damage caused by the arcing phenomenon, as detected by observing the surface of the FEA with an optical microscope. The arcing phenomenon causes a short circuit to occur between an anode, to which a highest potential, i.e., a positive voltage, is applied, and a gate electrode, to which a gate voltage lower than the positive voltage is applied. As a result of the short circuit between the anode and the gate electrode, the positive voltage is applied to the gate electrode, which damages a resistive layer formed on a gate oxide layer for electrically insulating a cathode electrode from the gate electrode and the cathode electrode. As the positive voltage increases, the probability of the resistive layer being damaged continues to grow. In the case of applying a positive voltage no smaller than 1 kV, the arcing phenomenon is even more likely to occur. Accordingly, in such case, it is impossible to obtain a high brightness field emission display which can stably operate even at a high voltage by adopting a simple structure of a conventional field emission display where an anode and a cathode are separated by spacers.

In the conventional field emission display, electrons extracted from a gate electrode travel toward a fluorescent surface while increasing their speeds, and thus some of the electrons may collide with the fluorescent surface beyond a given pixel due to diffusion of electron beams. This problem can be solved by providing an additional electrode for controlling electron beams on a predetermined electron beam path, i.e., focusing electron beams on a desired location on the fluorescent surface. The additional electrode corresponds to a second gate electrode in a field emission display and is formed as a single element, unlike first gate electrodes formed as stripes. The second gate electrode also prevents an arcing phenomenon from occurring in a field emission display. In this disclosure, a double gate field emission display having the second gate electrode is disclosed.

In the field emission display taught by U.S. Pat. No. 5,710,483, a second gate electrode is formed by deposition of a metal material. In a field emission display disclosed in Korean Patent Laid Open No. 2001-0081496, a metal mesh, manufactured separately from a cathode plate and an anode plate, is bridged to the cathode plate and the anode plate via spacers provided between the anode plate and the cathode plate As taught by U.S. Pat. No. 5,710,483, the size of the second gate electrode formed by metal deposition is dependent on the size of deposition equipment. Since the size of deposition equipment limits the size of the second gate electrode to a predetermined level or below, the patented technique is not appropriate for the manufacture of a large-sized field emission device. In order to manufacture a large-sized field emission device by taking advantage of the patented technique, metal layer deposition equipment must be newly designed and manufactured to be appropriate for the manufacture of a large-sized field emission display, which requires a considerable amount of money. In the patented technique, the thickness of the second gate electrode formed by metal deposition is limited to a maximum of 1.5 microns, which is not large enough to effectively control electron beams.

On the other hand, in the case of the field emission display taught by Korean Patent Laid Open No. 2001-0081496, a second gate electrode, i.e., a mesh grid, electrode is formed of a metal plate. Accordingly, unlike in U.S. Pat. No. 5,710,483, there is no limit in the size of the second gate electrode. Rather, the thickness of the second gate electrode can be freely selected, and thus it is possible to effectively control electron beams.

FIG. 1A is a cross-sectional view of a conventional field emission display having a mesh grid as a second gate electrode. Referring to FIG. 1, a cathode plate 10 and an anode plate 20 are separated from each other by spacers 30. Since a space between the cathode plate 10 and the anode plate 20 is vacuum, the cathode plate 10 and the anode plate 20 are firmly coupled together with the spacers 30 therebetween due to a negative pressure in the vacuum space.

A cathode electrode 12 is formed on a rear plate 11 of the cathode plate 10, and a gate insulation layer 13 is formed on the cathode electrode 12. The gate insulation layer 13 is formed having a through hole 13*a*, through which the cathode electrode 12 is exposed. An electron emission source 14, such as a carbon nano tube (CNT), is formed on the cathode electrode 12 exposed through the through hole 13*a*. A gate electrode 15 is formed on the gate insulation layer 13 to have a gate hole 15*a* corresponding to the through hole 13*a*.

An anode electrode 22 is formed on a front plate 21 of the anode plate 20, a fluorescent material layer 23 is formed on a predetermined surface of the anode electrode 22 facing the gate hole 15*a*, and a black matrix 24 is formed on the rest of the surface of the anode electrode 22.

A mesh grid 40 is interposed between the cathode plate 10 and the anode plate 20 and is supported by the spacers 30 being distant from both the cathode plate 10 and the anode plate 20.

The mesh grid 40 includes fixing holes 41, which the spacers 30 pass through, and an electron beam control hole 42 corresponding to the gate hole 15*a*. The fixing holes 41 are filled with binders 43 used to couple the mesh grid 40 with the spacers 30.

A conventional method of coupling spacers with other elements in the conventional field emission display is as follows.

The spacers 300 are arranged at intervals of a predetermined distance on the anode plate 20 in which the fluorescent material layer 23 has not yet been sintered and then are fixed onto the anode plate 20. The spacers 30 fixed onto the anode plate 20 are put into the fixing holes 41 of the mesh grid 40, and then the fixing holes 41 are filled with the binders 43 for fixing the spacers 30.

Thereafter, the mesh grid 40 and the spacers 30 are aligned with each other, the binders 41 are hardened, and then the fluorescent material layer 23 is sintered. Thereafter, the anode plate 20 and the cathode plate 10 are aligned with each other and hermetically sealed.

According to the conventional method of manufacturing a field emission display, the mesh grid 40 may be deformed or misaligned with the anode plate 20 during hardening the binders 43 at a temperature of about 120° C. and plasticizing the fluorescent material layer 23 at a temperature of about 420° C., or due to a high temperature applied when hermetically sealing the anode plate 20 and the cathode plate 10. FIG. 2A is a photograph of a screen of a field emission display manufactured by a conventional method. As shown in FIG. 2, the screen is not regular but spotted.

The deformation and misalignment of the mesh grid 40 with the anode plate 20 deteriorates the performance or causes the field emission display to malfunction. Accordingly, a new method of manufacturing a field emission device capable of solving the problems of the prior art is necessary.

SUMMARY OF THE INVENTION

The present invention provides a field emission display and a method of manufacturing the same, which are capable of effectively preventing a mesh grid from being deformed.

According to an aspect of the present invention, there is provided a field emission display. The field emission display includes an anode plate where an anode electrode and a fluorescent layer are formed, a cathode plate where an electron emission source emitting electrons toward the fluorescent material layer and a gate electrode having a gate hole through which the electrons travel are formed, a mesh grid having an electron control hole corresponding to the gate hole and adhered to the cathode plate, and an insulation layer formed on a surface of the mesh grid facing the cathode plate, and spacers provided between the anode plate and the mesh grid so that the mesh grid can be adhered to the cathode plate due to a negative pressure existing between the anode plate and the cathode plate.

Preferably, the mesh grid is formed of Invar®. Invar® (FeNi36) is a commercially available low thermal expansion alloy consisting of Fe, Ni, Cr, Mn, Si, C, P, S and Co.

Preferably, the insulation layer formed on the mesh grid is a $SiO_2$ layer formed by printing.

Preferably, the insulation layer formed on the mesh grid directly contacts a surface of the gate electrode.

According to another aspect of the present invention, there is provided a method of manufacturing a field emission display. The method includes preparing an anode plate where an anode electrode and a fluorescent material layer are formed, preparing a cathode plate where an electron emission source emitting electrons toward the fluorescent layer and a gate electrode having a gate hole through which the electrons travel are formed, manufacturing a mesh grid having an electron control hole corresponding to the gate hole so that the mesh grid can be adhered to the cathode plate and an insulation layer is formed on a surface of the mesh grid facing the cathode plate, arranging the mesh grid on the cathode plate so that the insulation layer on the mesh grid can face the cathode plate, and interpolating spacers having a predetermined height between the cathode plate and the anode plate and hermetically sealing the anode plate and the cathode plate.

Preferably, the mesh grid is formed of Invar® (FeNi36).

Preferably, the insulation layer is formed by printing a $SiO_2$ paste on the mesh grid and sintering the $SiO_2$ paste.

Preferably, the insulation layer is formed of $SiO_2$ on the mesh grid.

Preferably, manufacturing the mesh grid includes forming an insulation layer on a surface of a metal plate, forming an electron control hole in the metal plate by performing photolithography on the other surface of the metal plate, and making the electron control penetrate the insulation layer by removing part of the insulation layer corresponding to the electron control hole.

Preferably, forming the insulation layer on the metal plate includes coating the metal plate with a $SiO_2$ paste, and sintering the $SiO_2$ paste printed on the metal plate.

Preferably, hermetically sealing the anode plate and the cathode plate including arranging the spacers on the inner surface of the anode plate and fixing the spacers to the anode plate by using binders, hardening the binders and sintering the fluorescent layer at the same time by heating the anode plate, and coupling the cathode plate and the anode plate so that the spacers can contact the mesh grid and hermetically sealing the coupled body of the cathode plate and the anode plate.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The above features and advantages of the present invention will become more apparent by describing in detail exemplary embodiments thereof with reference to the attached drawings in which.

DETAILED DESCRIPTION OF THE INVENTION

Hereinafter, the present invention will be described in greater detail with reference to the accompanying drawings, in which preferred embodiments of the present invention are shown.

Figure 1A:
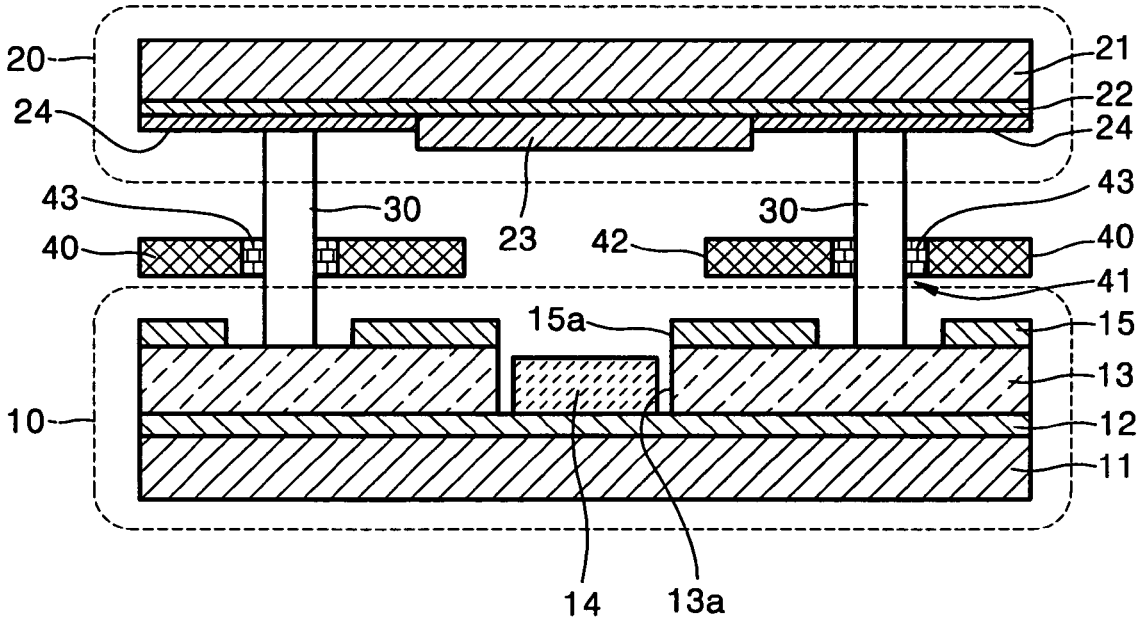
FIG. 1A (PRIOR ART)
FIG. 1A is a cross-sectional view of a conventional field emission display.
Figure 1B:
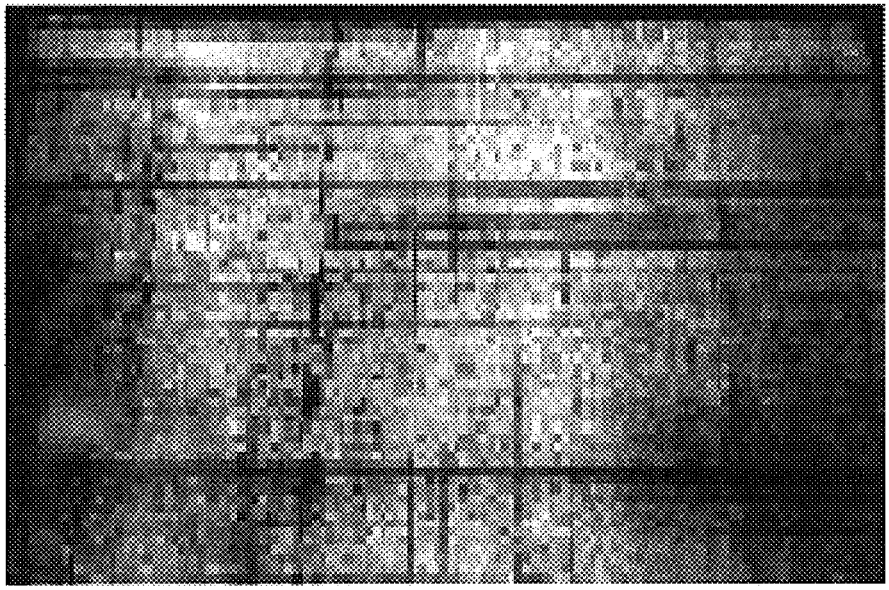
FIG. 1B (PRIOR ART)
FIG. 1B is a photograph of a conventional field emission display screen spotted due to a deformed mesh grid.
Figure 2:
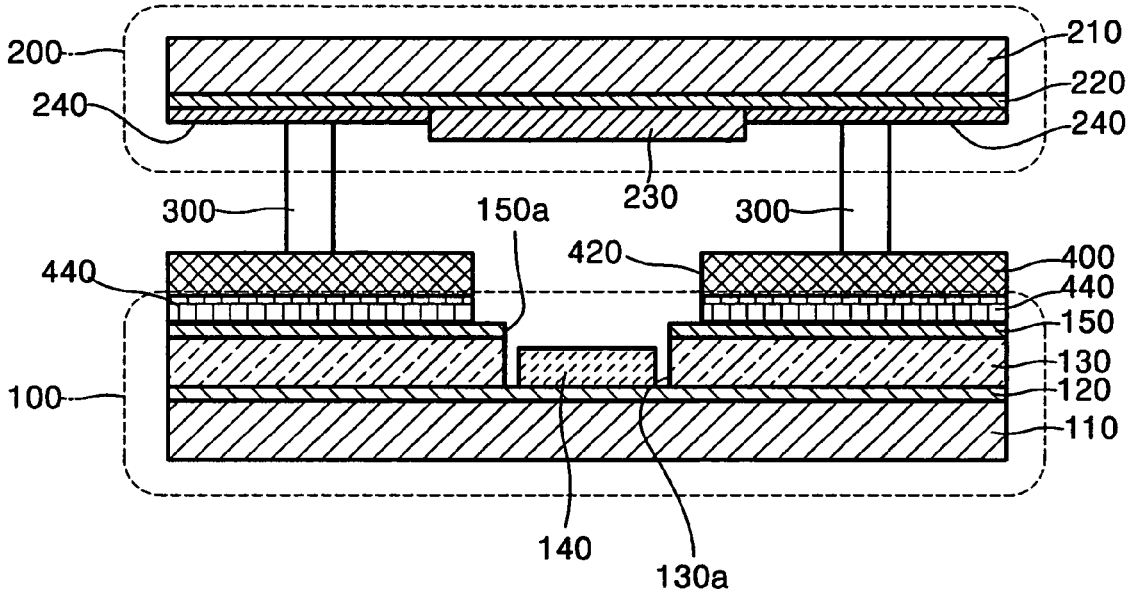
FIG. 2 is a cross-sectional view of a field emission display according to a preferred embodiment of the present invention.

FIG. 2 is a cross-sectional view of a field emission display according to a preferred embodiment of the present invention. Referring to FIG. 2, a cathode plate 100 and an anode plate 200 are placed apart by spacers 300. The cathode plate 100 and the anode plate 200 are hermetically sealed so that a vacuum space exists therebetween. Due to a negative pressure existing between the cathode plate 100 and the anode plate 200, the cathode plate 100 and the anode plate 200 are firmly coupled together by the spacers 300 therebetween.

A cathode electrode 120 is formed on a rear plate 110 of the cathode plate 100, and a gate insulation layer 130 is formed on the cathode electrode 120. A through hole 130*a*, through which the cathode electrode 120 is exposed, is formed in the gate insulation layer 130. An electron emission source 140, such as a carbon nano tube (CNT), is formed on the cathode electrode 120 exposed through the through hole 130*a*. A gate electrode 150 is formed on the gate insulation layer 130 to have a gate hole 150*a* corresponding to the through hole 130*a*.

An anode electrode 220 is formed under a front plate 210 of the anode plate 200. A fluorescent layer 230 is formed on a predetermined bottom surface of the anode electrode 220 so as to face the gate hole 150*a*, and a black matrix 240 for preventing absorption of light from the outside and occurrence of optical cross torque is formed on the rest of the bottom surface of the anode electrode 220.

A mesh grid 400 is interposed between the cathode plate 100 and the anode plate 200. In particular, the mesh grid 400 tightly contacts the cathode plate 100 due to the spacers 300. The cathode plate 100 is separated from the anode plate 200. As described above, there exists a vacuum space between the cathode plate 100 and the anode plate 200, and the mesh grid 400 firmly contacts the cathode plate 100 due to the spacers 300.

An insulation layer 440 is formed between the bottom surface of the mesh grid 400 which faces the gate electrode 150 and is strongly adhered to the top surface of the gate electrode 150. The mesh grid 400 has a electron beam control hole 420 corresponding to the gate hole 150*a*.

The main characteristics of the electron emission display according to the present invention is that the mesh grid 400 manufactured separately from metal plates, such as the cathode plate 100 and the anode plate 200, are closely adhered to the gate electrode 150 and the spacers 300 apply pressure onto the mesh grid 400 in order to adhere the mesh grid 400 to the cathode plate 100.

Hereinafter, a method of manufacturing a field emission display according to a preferred embodiment of the present invention will be described in greater detail.

Figure 3:
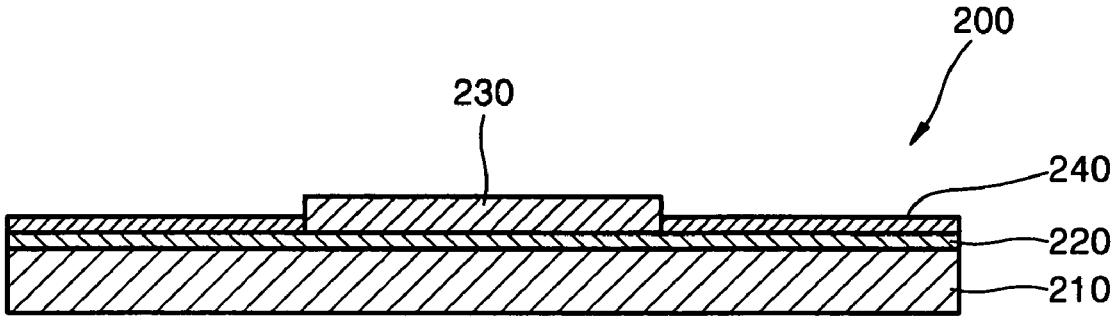
FIGS. 3 through 6 are cross-sectional views illustrating elements of a field emission display according to a preferred embodiment of the present invention.

As shown in FIG. 3, an anode plate 200 where an anode electrode 220, a fluorescent layer 230, and a black matrix 240 are formed on a front plate 210 is provided. Here, the anode plate is formed by a conventional method, and the fluorescent material layer 230 has not yet been sintered.

Figure 4:
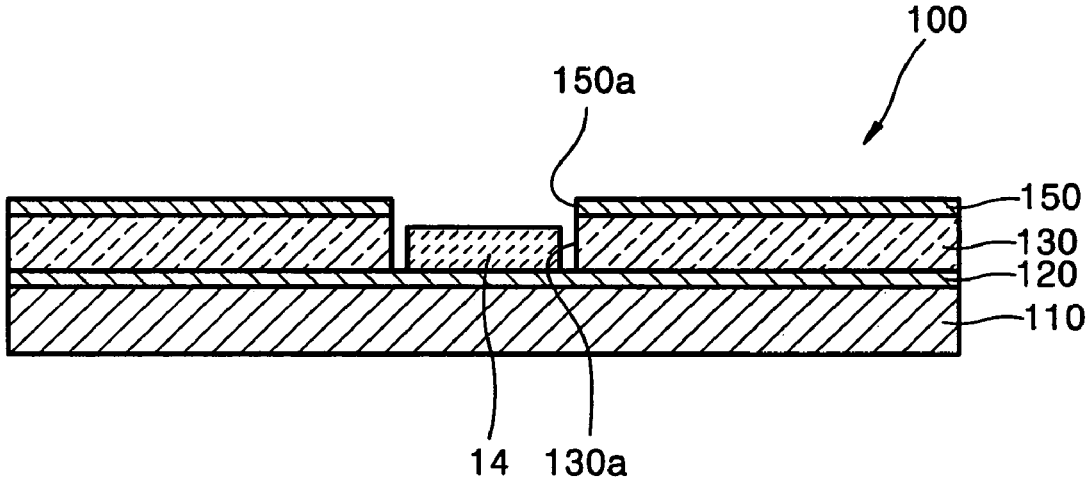

Thereafter, a cathode plate 100 having a structure shown in FIG. 4 is provided. Specifically, a cathode electrode 120 is formed on a rear plate 110, an electron emission source 140 emitting electrons toward the fluorescent layer 230 is formed on the cathode electrode 120, a gate insulation layer 130 is formed on the cathode electrode 120, and a gate electrode 150 is formed on the gate insulation layer 130 to have a gate hole 150*a* through which the electrons travel. The cathode plate is formed by a conventional method, and the fluorescent layer 230 has not yet been sintered.

Figure 5:
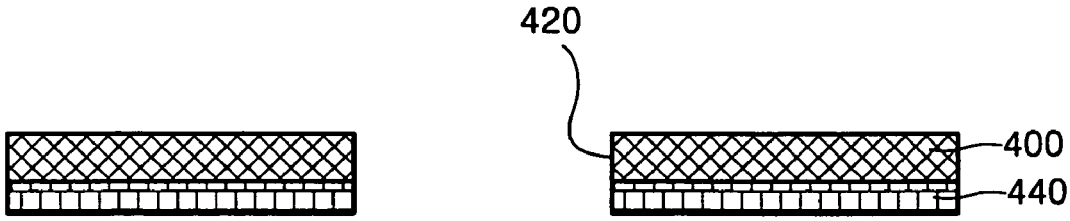

As shown in FIG. 5, a mesh grid 400 having an electron control hole 420 is formed, and an insulation layer 440 is formed on the bottom surface of the mesh grid 400.

Figure 6:
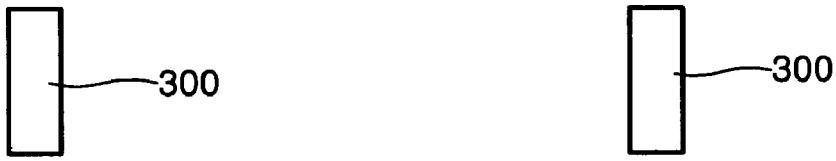

As shown in FIG. 6, a plurality of spacers 300 having a predetermined height are prepared.

Figure 7:
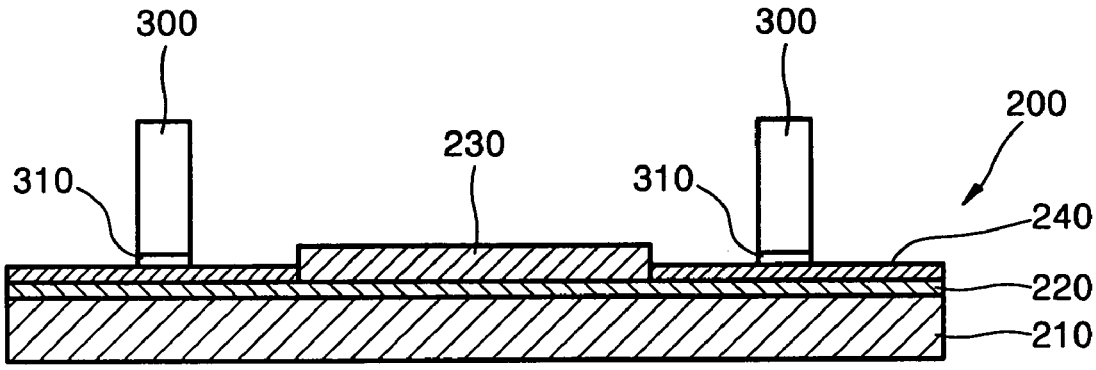
FIGS. 7 through 9 are cross-sectional views illustrating a method of manufacturing a field emission display according to a preferred embodiment of the present invention.

As shown in FIG. 7, the spacers 300 are arranged on and then bonded to the anode plate 200. Here, the spacers 300 are bonded to the anode plate 200 by using paste-type binders 310. The fluorescent layer 230 is sintered and the binders 310 are hardened at the same time by heating a coupled body of the spacers 300 and the anode plate 200.

Figure 8:
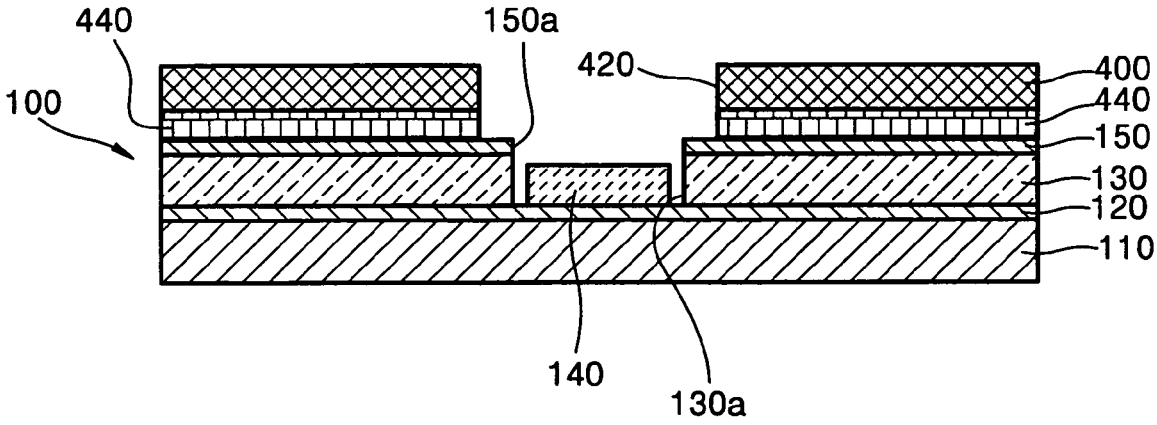

As shown in FIG. 8, the mesh grid 400 is installed on the cathode plate 100.

Figure 9:
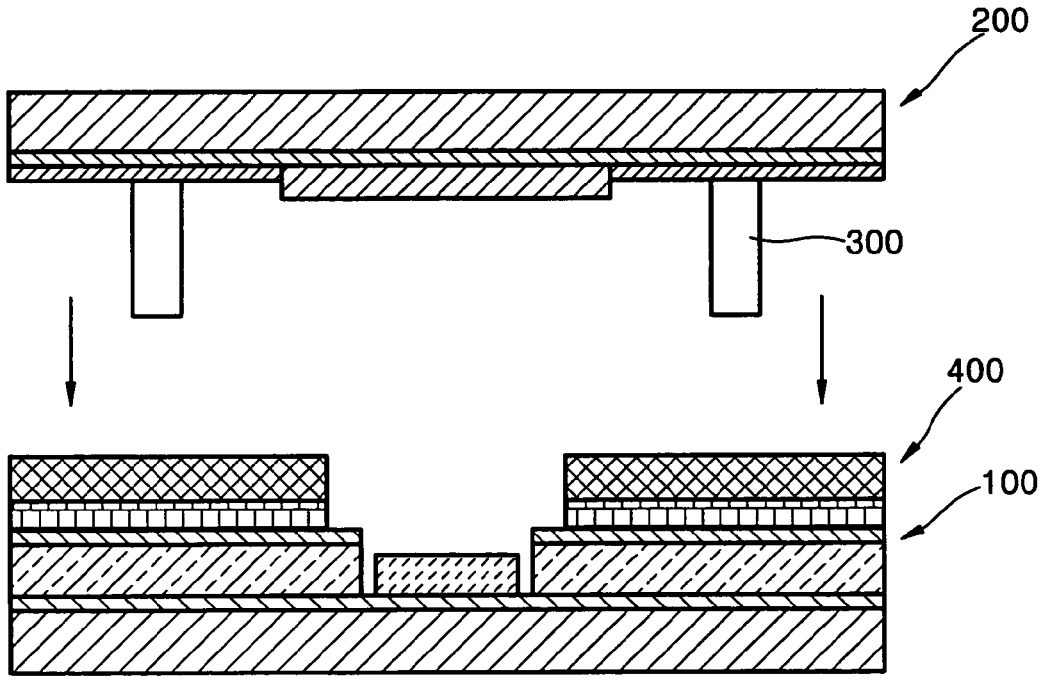

As shown in FIG. 9, the cathode plate 100 and the anode plate 200 are coupled together, and thus a field emission display, like the one shown in FIG. 2, is obtained.

As described above, the mesh grid 400 is not installed between the cathode plate 100 and the anode plate 200 until the fluorescent material layer 230 and the binders 310 are sintered. Accordingly, it is possible to effectively prevent the mesh grid 400 from being deformed during the sintering of the fluorescent layer 230 and the binders 310.

Figure 10:
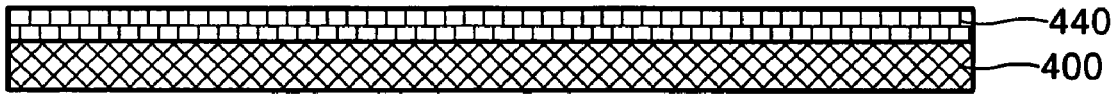
FIGS. 10 through 12 are cross-sectional views illustrating a method of manufacturing a mesh grid in a method of manufacturing a field emission display according to a preferred embodiment of the present invention.
Figure 11:
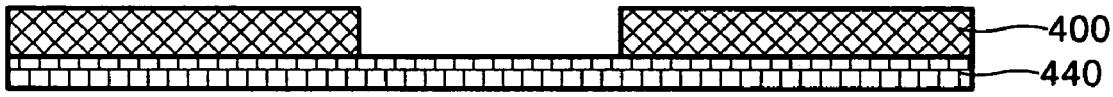

FIGS. 10 through 11 are cross-sectional views illustrating a method of manufacturing the mesh grid 400 in a method of manufacturing a field emission display according to a preferred embodiment of the present invention.

As shown in FIG. 10, a $SiO_2$ paste is printed on an Invar® (FeNi36) having a thickness of about 50-100 microns by squeezing the $SiO_2$ paste on the Invar® (FeNi36) and then is sintered at a temperature of about 530° C.

As shown in FIG. 11, an electron control hole 420 is formed in the Invar® (FeNi36) by photolithography. During the photolithography, a photoresist mask having a window corresponding to the electron control hole 420 can be used, and ferric chloride can be used as an etchant.

Figure 12:
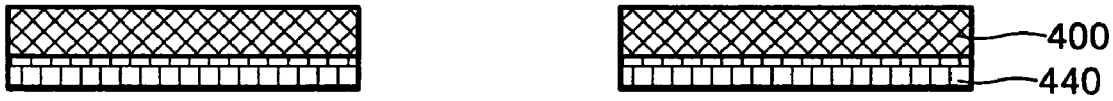

As shown in FIG. 12, the SiO2 layer 440 is etched using the Invar® (FeNi36) 400 having the electron control hole 420 as a mask so that the electron control hold 420 can be a through hole.

Figure 13:
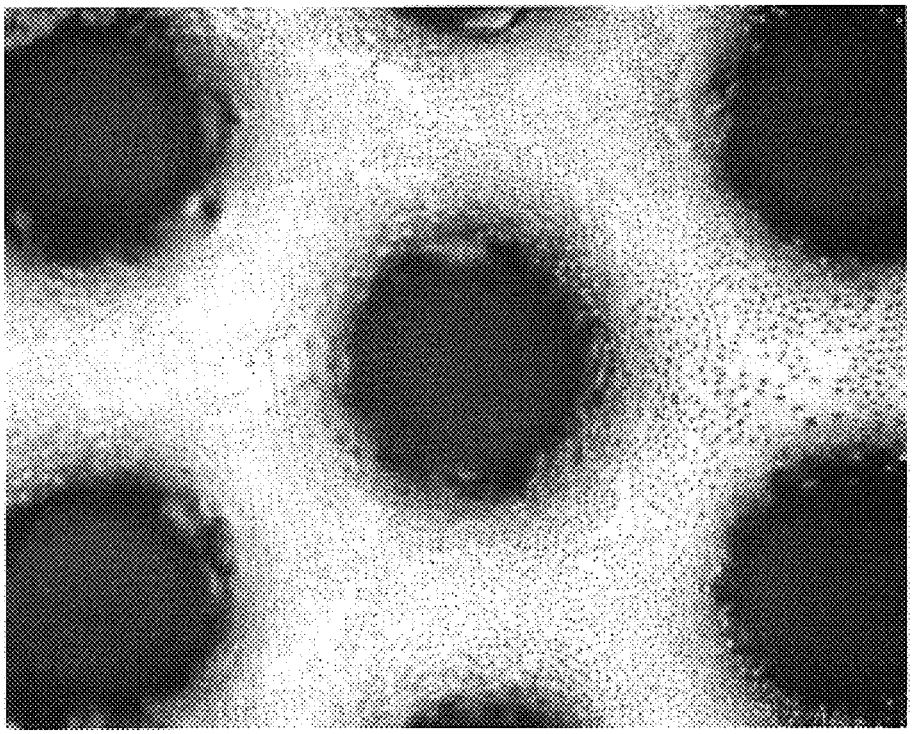
FIG. 13 is an enlarged photograph of the surface of a mesh grid manufactured by a method of manufacturing a field emission display according to a preferred embodiment of the present invention.

FIG. 13 is an enlarged photograph of a mesh grid manufactured according to the above-described manufacturing method.

In the above-described method of manufacturing a mesh grid, an insulation layer is formed by a printing method. Accordingly, the mesh grid manufacturing method is appropriate for the manufacture of a large-sized field emission display having a very large area. In addition, since an invar is used as an etching mask in the patterning of the insulation layer, the whole manufacturing processes can be simplified.

According to the present invention, it is possible to completely prevent elements, and more specifically, a mesh grid, from being deformed due to plasticization of a fluorescent layer. Since the mesh grid is separately formed of a metal plate rather than to be deposited on an anode plate and an insulation layer is formed on the mesh grid by a squeezing method, the method of manufacturing a field emission display according to the present invention is appropriate for the manufacture of a field emission display having a large area.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A field emission display, comprising:

an anode plate where a fluorescent layer is formed on an anode electrode;

a cathode plate where an electron emission source emitting electrons toward the fluorescent material layer and a gate electrode having a gate hole through which the electrons travel are formed;

a mesh grid having an electron control hole corresponding to the gate hole and an insulation layer formed on a surface of the mesh grid that faces the cathode plate, wherein the mesh grid is a separate metal plate; and spacers provided between the anode plate and the cathode plate such that the spacers are bonded to the anode plate and supported by the mesh grid so that the mesh grid contacts the cathode plate due to a negative pressure existing between the anode plate and the cathode plate.

2. The field emission display of claim 1, wherein the mesh grid is formed of FeNi36.

3. The field emission display of claim 1, wherein the insulation layer formed on the mesh grid is a $SiO_2$ layer formed by printing.

4. The field emission display of claim 2, wherein the insulation layer formed on the mesh grid is a printed $SiO_2$ layer.

5. The field emission display of claim 3, wherein the insulation layer formed on the mesh grid directly contacts a surface of the gate electrode.

6. The field emission display of claim 4, wherein the insulation layer formed on the mesh grid directly contacts a surface of the gate electrode.

* * * * *